US007938663B2

(12) United States Patent
Leipold et al.

(10) Patent No.: US 7,938,663 B2
(45) Date of Patent: May 10, 2011

(54) COAXIAL CONNECTOR PIECE

(75) Inventors: Markus Leipold, Isen (DE); Thomas Reichel, Baldham (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 0 days.

(21) Appl. No.: 12/375,483

(22) PCT Filed: Jan. 25, 2008

(86) PCT No.: PCT/EP2008/000593

§ 371 (c)(1),
(2), (4) Date: Mar. 10, 2009

(87) PCT Pub. No.: WO2008/104254

PCT Pub. Date: Sep. 4, 2008

(65) Prior Publication Data

US 2009/0264016 A1 Oct. 22, 2009

(30) Foreign Application Priority Data

Feb. 27, 2007 (DE) ..... 10 2007 009 516
May 15, 2007 (DE) ..... 10 2007 022 744

(51) Int. Cl.
*H01R 13/62* (2006.01)

(52) U.S. Cl. ..... 439/322

(58) Field of Classification Search ..... 439/322, 439/321, 323

See application file for complete search history.

(56) References Cited

U.S. PATENT DOCUMENTS

| | | | | |
|---|---|---|---|---|
| 2,531,021 | A * | 11/1950 | Bard | 285/276 |
| 3,609,651 | A | 9/1971 | Sladek et al. | |
| 3,983,304 | A * | 9/1976 | Sekhon | 411/504 |
| 4,340,269 | A * | 7/1982 | McGeary | 439/583 |
| 4,431,354 | A * | 2/1984 | Griffin | 411/301 |
| 4,444,453 | A * | 4/1984 | Kirby et al. | 439/583 |
| 4,801,274 | A * | 1/1989 | Royce | 439/322 |
| 4,854,893 | A * | 8/1989 | Morris | 439/578 |
| 5,165,734 | A * | 11/1992 | Smith | 285/276 |
| 6,293,595 | B1 * | 9/2001 | Marc et al. | 285/92 |
| 6,607,403 | B2 * | 8/2003 | Tschope et al. | 439/607.42 |
| 6,808,407 | B1 | 10/2004 | Cannon | |
| 7,281,947 | B2 * | 10/2007 | Pescatore | 439/578 |
| 7,419,191 | B2 * | 9/2008 | Shu | 285/276 |
| 2005/0037664 | A1 | 2/2005 | Weidner | |
| 2005/0170692 | A1 | 8/2005 | Montena | |
| 2005/0264377 | A1 | 12/2005 | Faulkner et al. | |

FOREIGN PATENT DOCUMENTS

| | | |
|---|---|---|
| DE | 74 27 964.40 | 8/1974 |
| DE | 74 27 964.4 | 8/2004 |
| DE | 10 2004 017 803 | 3/2005 |
| EP | 0 327 204 | 8/1989 |
| EP | 0 955 701 | 11/1999 |
| WO | WO-2007/002692 | 1/2007 |

* cited by examiner

OTHER PUBLICATIONS

International Search Report for PCT/EP2008/000593 dated Sep. 10, 2008.

*Primary Examiner* — T C Patel
*Assistant Examiner* — Harshad C Patel
(74) *Attorney, Agent, or Firm* — Marshall, Gerstein & Borun LLP

(57) ABSTRACT

In a coaxial plug-connector part with a cap nut, which is disposed rotatably and in an axial force-fit manner on the outer-conductor and which can be screw-connected, in order to generate the contact pressure between the outer-conductor butting contact surfaces of the plug connector, with an external thread of the counter plug-connector part, the frictional torque of the axial force-fit between the cap nut and the outer-conductor is selected to be smaller than the frictional torque between the outer-conductor butting contact surfaces of the plug connector.

10 Claims, 2 Drawing Sheets

COAXIAL CONNECTOR PIECE

BACKGROUND OF THE INVENTION

1. Field of the Invention

The invention relates to a coaxial plug-connector part according to the preamble of the independent claim. A coaxial plug-connector part of this kind is known, for example, from WO 2007/002692 A1.

2.Related Technology

FIG. 1 shows the longitudinal section through a coaxial plug connector as it is known in a similar design, for example, as an N-plug. It includes a plug part, generally designated 1 and a jack part, generally designated 2. The plug 1 includes an outer-conductor 3, within which, via a connecting washer 4, the internal conductor 5 is arranged in a coaxial manner. The coaxial line including the inner conductor 5 and the outer-conductor 3 continues at the rear of the plug 1, which is not illustrated in greater detail, for example, in a device or in a coaxial cable. On the outer-conductor 3, a cap nut 6, which is connected via a retaining ring 7 in an axial force-fit manner to the outer-conductor 3, is placed in a rotatable manner. The internal thread 8 of the cap nut 6 must be screwed onto the external thread 9 of the jack 2 in order to manufacture the coaxial connection, until the annular butting contact surface 10 of the outer-conductor 3 of the plug 1 contacts the corresponding annular butting contact surface 11 of the jack 2. In this context, the tip 12 of the internal conductor 5 is pushed into the radially-resilient sleeve-shaped bush 13 of the jack part 2.

The currently commercially-available coaxial plug connectors, as they are known by the references N-, 2.92 mm, SMA-, 1.85 mm-, 3.5 mm-, or 2.4 mm-plugs or respectively as so-called hermaphrodite connectors under the reference PC7, are all constructed according to this principle with a cap nut screwed onto the outer-conductor, wherein, in many cases, the cap nut can also be provided on the jack part.

The quality of a coaxial plug connector is quite substantially dependent upon a sufficiently-large axial pre-tensioning. Excessively small values can lead to an unreliable connection, because the low contact pressure on the outer-conductor is insufficient to guarantee a consistently-low transitional resistance over the entire periphery of the circular contact surface. As a result of the disturbed current distribution in the contact region of the outer-conductor, reflections and increases in attenuation can occur at relatively high frequencies: an effect which can hardly be determined in the low-frequency range, because there, a low transitional resistance even at a single contact point is sufficient for the entire connection.

Furthermore, an excessively-low axial pre-tensioning has the disadvantage that a plug connector can easily be loosened, especially by torque engagement with the screw-connected parts, without the cap nut coming into play. Conversely, an excessively-strong tightening can lead to premature wear of the plug and significant dimensional changes as a result of the mechanical stresses introduced. This applies in particular for parts with defined electrical length, such as short circuits in calibration kits.

SUMMARY OF THE INVENTION

The invention avoids these disadvantages in a coaxial connection and provides a reliable and durable plug-connector part.

Accordingly, the invention provides a coaxial plug-connector part with a cap nut disposed rotatably and in an axial force-fit manner on an outer-conductor, which can be screw-connected in order to generate the contact pressure between the outer-conductor butting contact surfaces of the plug connector with an external thread of a counter plug-connector part, wherein the frictional torque of the axial force-fit between the cap nut and the outer-conductor is selected to be smaller than the frictional torque between the outer-conductor butting contact surfaces of the plug connector.

The invention is based upon the knowledge that the friction conditions in the region of the axial force-fit between the cap nut and the outer-conductor of a coaxial high-frequency plug connector have a decisive influence on the quality of the plug connection. By reducing the coefficients of friction between these parts, a relatively-high contact pressure is achieved according to the invention with a specified tightening torque; moreover, the outer-conductor, does not rotate so readily, and a relatively-higher security with regard to accidental loosening of the plug connection is also provided.

BRIEF DESCRIPTION OF THE DRAWINGS

Exemplary embodiments of the invention are described in greater detail below with reference to the drawings. The drawings are as follows.

DETAILED DESCRIPTION

Figure 1:
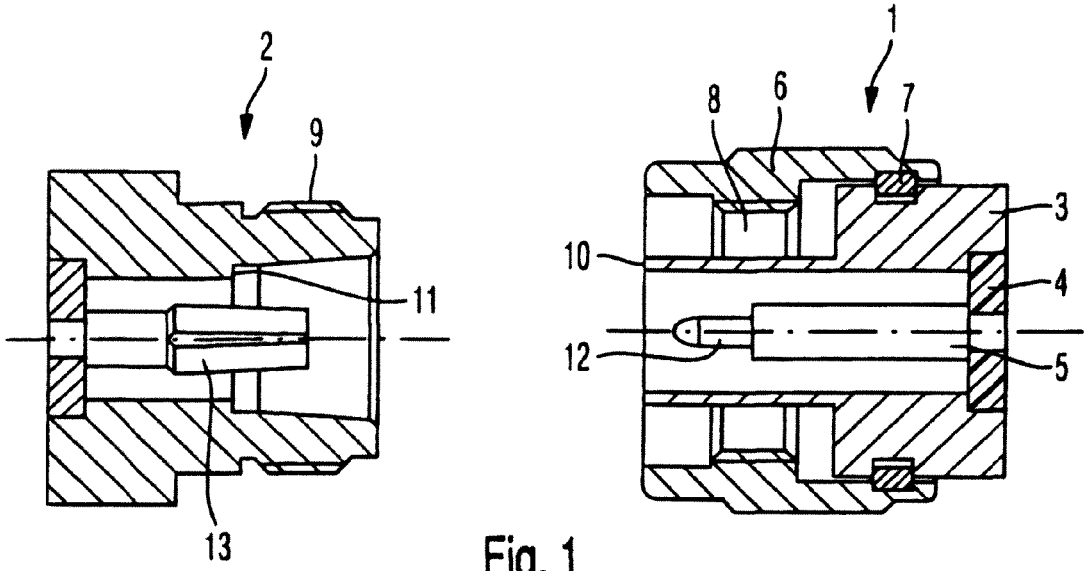
Fig. 1 (PRIOR ART)
FIG. 1 shows a section through a known plug connector.

The following section presents the basic relationships between the torque exercised on the cap nut and the axial pre-tensioning force caused as a result. In this context, the influence of friction and adhesion on the various mechanical contact surfaces is of particular importance. It is evident that the retaining ring used for the transfer of force from the nut to the outer-conductor of the plug has a considerable influence on the axial pre-tension attainable and the reliability of the connection.

The attainable pre-tensioning force and the subdivision of the tightening torque in this context are obtained as follows:

The torque M to be applied to the cap nut is proportional to the desired axial pre-tensioning force F:

$$M=K\cdot F \tag{1}$$

In this context, the coefficient K depends upon the dimensions of the screw connection and the various coefficients of friction. A distinction can be made between two cases:

a) The outer-conductors of the plug and the jack do not rotate against one another during the tightening of the screw (desired case). Alongside the effect of the thread (pitch p) and the friction in the thread (coefficient of friction $\mu_g$), the friction between the cap nut and the retaining ring or the retaining ring and the outer-conductor must also be taken into consideration (coefficient of friction $\mu_s$; the smaller of the values applies). If β denotes the thread angle of the thread (normally 60°), $d_m$ denotes the pitch diameter and $d_s$ denotes the mean diameter of the retaining ring, the following applies:

$$K_a = \frac{p}{2\pi} + \mu_g \frac{d_m}{2\cos(\beta/2)} + \mu_s \frac{d_s}{2} \tag{2}$$

b) During the tightening of the plug connector, the outer-conductor of the plug is carried round completely by the rotating cap nut. In this case, the butting surfaces of the outer-conductor of the plug and the jack rub against one another. By analogy with (2), with $d_o$ as the mean diameter of the butting surface and $\mu_o$ as the associated coefficient of friction:

$$K_b = \frac{p}{2\pi} + \mu_g \frac{d_m}{2\cos(\beta/2)} + \mu_o \frac{d_o}{2} \tag{3}$$

For the cases a) and b), Table 1 shows which pre-tensioning force F is achieved with a torque of 12 inch-lbs for an N-plug connector, and how the tightening torque applied to the nut is subdivided. In this context, an N-plug connector made of stainless steel with a retaining ring made of bronze is assumed. The coefficients of friction are taken to be as follows: steel on steel (butting surface and thread) 0.15; bronze on steel 0.20 (dry) or 0.05 (lubricated).

TABLE 1

Pre-tensioning force and subdivision of torque for an N-plug connector

| | | Without rotation of outer conductor | | With rotation |
|---|---|---|---|---|
| | | Un-lubricated | Lubricated | . . . |
| | Pre-tensioning force in N | 415 | 702 | 662 |
| Subdivision of tightening torque | Pre-tension | 5% | 9% | 8% |
| | Friction in thread | 40% | 68% | 64% |
| | Friction in retaining ring | 55% | 23% | — |
| | Friction on butting surface | — | — | 28% |

A comparison of the cases a)—dry and b) highlights the phenomenon known to every practitioner, that an N connection can be tightened more firmly, if a rotation of the outer-conductors relative to one another is permitted. However, the same effect can evidently also be achieved without rotation with a lubricated retaining ring, which, inter alia, protects the contact surfaces of the inner and outer conductors.

Even if the large pre-tensioning forces obtained with a lubricated retaining ring are not required, it would be desirable for the two outer-conductors not be rotated against one another by the tightening of the cap nut. This is the case, if the torque applied via the retaining ring to the outer-conductor is not sufficient to rotate the butting surfaces relative to one another. With $\mu'_o$ as the coefficient of adhesion on the butting surface, the following condition applies:

$$\mu_s < \mu'_o \frac{d_o}{d_s} \tag{4}$$

Since the diameter of the retaining ring must for technical reasons be significantly larger than the mean butting-surface diameter—with conventional plug systems N, SMA or 2.4, it is approximately double the size—the coefficient of friction between the retaining ring and the nut or the retaining ring and the outer-conductor must in every case be significantly smaller than on the butting surface. With a coefficient of adhesion $\mu'_o$ of 0.18, a maximum coefficient of friction $\mu_s$ of 0.076 would be required according to this consideration, which could be achieved in the lubricated case.

In any case, the best security against the loosening of a screw connection is certainly a sufficiently large pre-tensioning force. This is based on the consideration that the axial deformation of the screw caused as a result is so great, that the pre-tensioning is preserved even under the influence of thermal expansion and externally-applied torque. However, in the case of conventional coaxial plug connectors, precisely this deformation is undesirable, because the length of the coaxial line portion, which is disposed in the region of the deformation zone, would change as a result. For this reason, the tightening torque is also kept far below the yield point of the material. Accordingly, in the case of a lubricated plug connector, the surface compression of approximately 60 N/mm$^2$ occurring on the butting surface of the outer-conductor (Table 1) is far below the compressive resistance of stainless steel. Conversely, the outer-conductor of the plug is already deformed by 3 μm under these conditions, which corresponds to a phase change of 0.12° at 18 GHz in the case of a twofold passage of the connection, for example, for an offset short.

The security of a screw-connected coaxial plug connector against loosening must therefore be formulated in a different manner. It should be required that the loosening moment for the cap nut does not differ substantially from the tightening torque, and the connection must not be loosened, if the outer-conductors are rotated against one another.

Furthermore, for the release of the cap nut, as for the making of the connection, a distinction must be made between cases with and without mutual rotation of the outer-conductors.

If the outer-conductors do not rotate relative to one another, the following applies for the loosening moment:

$$M_1 = \left(\mu'_g \frac{d_m}{2\cos(\beta/2)} + \mu'_s \frac{d_s}{2} - \frac{p}{2\pi}\right) \cdot F \tag{5}$$

If the outer-conductor is carried around, the following applies:

$$M_1 = \left(\mu'_g \frac{d_m}{2\cos(\beta/2)} + \mu'_o \frac{d_o}{2} - \frac{p}{2\pi}\right) \cdot F \tag{6}$$

If the conditions during tightening, which make themselves noticeable through different pre-tensioning forces F, are included, four cases can be distinguished, as presented in Table 2. The tightening torque has been assumed to be a uniform 12 inch-lbs, the coefficients of adhesion were selected to be 20% higher than the coefficients of friction, upon which the values in Table 1 are based.

TABLE 2

Loosening moments on the cap nut of an N-plug connector (bracketed value for lubricated retaining ring)

| | | Loosening of the connection | |
|---|---|---|---|
| | | Without rotation | With rotation |
| Making of the connection | without rotation | 13 (12) inch-lbs | 8 inch-lbs |
| | with rotation | 21 inch-lbs | 12 inch-lbs |

The wide variation in the loosening moments for a connection with un-lubricated retaining ring, in particular, the low value of 8 inch-lbs is especially remarkable. By contrast, in the lubricated case, which causes no rotation, the tightening moment is reached.

By contrast with a conventional screw connection, coaxial plug connectors are often loosened—unintentionally or as a result of the structure of the test—by applying a torque to the outer-conductor. So that the connection cannot be loosened even with very large torques, the torque transferable via the retaining ring to the nut must be smaller than the opposing moment of the thread. Since the pitch of the thread opposes the friction during loosening, the following condition must be fulfilled:

$$\mu'_s \frac{d_s}{2} < \mu'_g \frac{d_m}{2\cos(\beta/2)} - \frac{p}{2\pi} \tag{7}$$

After resolving with reference to $\mu'_s$, the following is obtained:

$$\mu'_s < \mu'_g \frac{d_m}{d_s\cos(\beta/2)} - \frac{p}{d_s\pi} \tag{8}$$

For an N-plug connector with $\mu'_g$=0.18, a maximum permitted coefficient of adhesion $\mu'_s$ of 0.16 in the region of the retaining ring would be obtained according to this consideration. With a dry retaining ring, this is generally not attainable; but is always attainable with lubrication.

These considerations show that, even in the simplest case, it is sufficient to lubricate the retaining ring 7 illustrated in FIG. 1 or respectively to provide the surface of the cap nut 6 co-operating with this retaining ring 7 or respectively of the outer-conductor 3 with a corresponding slidable coating. Instead of a lubricating agent, the retaining ring or respectively the surfaces cooperating with the latter could therefore also be provided with a Teflon coating or a nano-glide film. In principle, any slidable coating is suitable for this purpose, for example, also so-called solid lubricants.

With commercially-available N-plug connections, the outer-conductor and the cap nut generally consist of stainless steel, and the retaining ring, for example, of bronze. In order to reduce the coefficient of friction, these parts can also be made of other materials providing a lower coefficient of friction, for example, an appropriate metal or synthetic material.

FIGS. 2 to 6 show further possibilities for reducing the coefficient of friction between the cap nut 6 and the outer-conductor 3 by incorporating appropriate rolling bearings. For this purpose, many types of bearing are once again suitable, for example, axial and radial ball bearings, axial roller bearings, axial needle bearings, transverse ball bearings or also simple axial sliding bearings.

Figure 2:
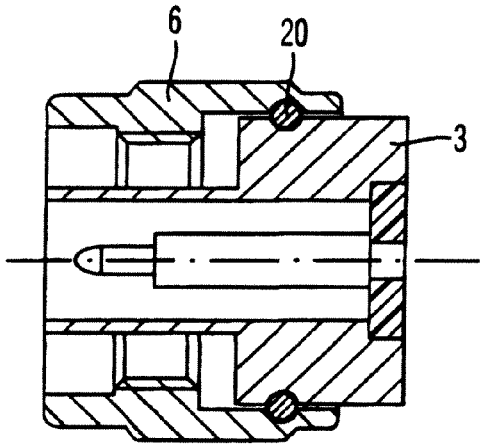
FIG. 2 shows a section through a first exemplary embodiment according to the invention.

FIG. 2 shows the incorporation of a radial ball bearing 20 between the cap nut 6 and the outer-conductor 3. Each radial ball bearing acts not only as a radial bearing but, up to a given load, also as an axial bearing and is therefore also suitable for the purpose of the invention. The balls 20 mounted in a cage crown run in corresponding annular grooves around the internal periphery of the cap nut or respectively the external periphery of the outer-conductor 3. In the case of an axial screw connection of the plug 1 and the jack 2, the frictional force of the axial force-fit between the cap nut and the outer-conductor 3 is considerably reduced via this ball bearing 20, and accordingly the purpose of the invention is achieved.

Figure 3:
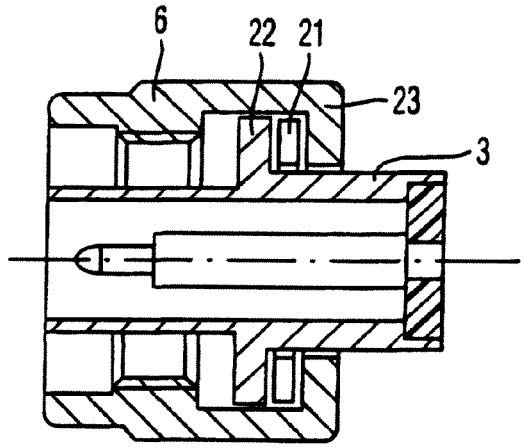
FIG. 3 shows a section through a second exemplary embodiment according to the invention.

FIG. 3 shows another possibility using a needle bearing or cylindrical roller bearing. The cylindrical rollers or needles 21, also arranged in the shape of a crown within a cage, run on the annular butting surfaces of a flange 22 of the outer-conductor 3 and the opposing annular butting surface of a radial flange 23 of the cap nut drawn inwards. In the case of the axial screw connection of the plug 1 and the jack 2, these rollers 21 also have the effect of reducing the frictional force.

Figure 4:
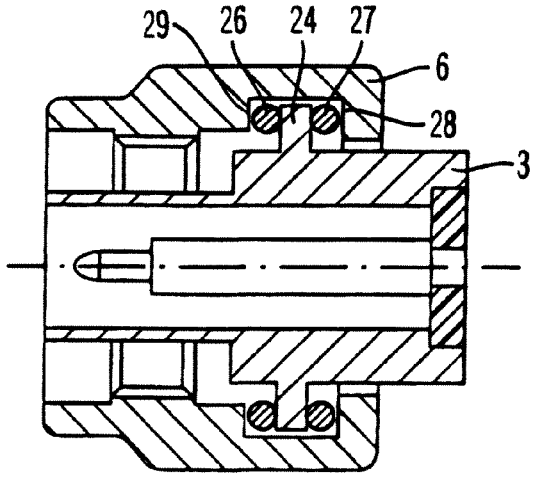
FIG. 4 shows a section through a third exemplary embodiment according to the invention.

Finally, FIG. 4 shows how the frictional force between the cap nut 6 and the outer-conductor 3 can be reduced by a double rolling bearing in both axial directions.

A radially-projecting flange 24, on the opposing annular surfaces of which ball bearings 26, 27 run, which, for their part, are mounted in corresponding grooves 28, 29 in the inside of the cap nut 6, is provided on the outer-conductor 3. Accordingly, the coefficient of friction of the axial force-fit between the cap nut and the outer-conductor is considerably reduced both during the tightening of the cap nut 6 on the jack 2 via the roller bearing 27, and also, at the same time, in the opposite axial direction, via the second rolling bearing 26, so that the cap nut 6 can be rotated on a ball-bearing even in the non screw-connected position.

In the exemplary embodiment according to FIGS. 2 and 4, the rolling bearings and their arrangement between cap nut and outer-conductor are each presented only schematically; in practice, it is, of course, necessary for the installation of the rolling bearings, to design the retaining parts, such as the outer-conductor, cap nut and similar, in such a manner that they can be divided and, for example, screwed together. For reasons of visual clarity, these pure design features required for assembly have not been illustrated.

Figure 5:
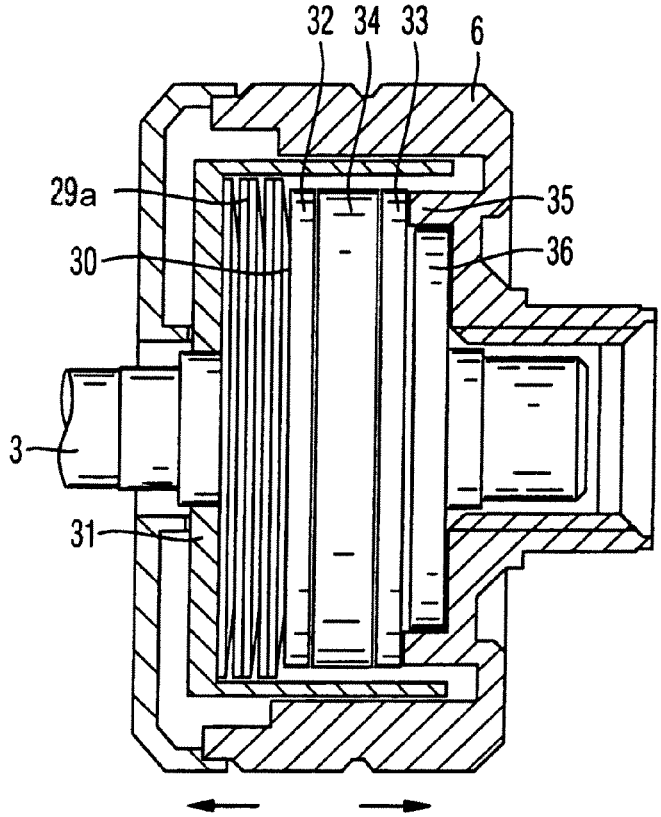
FIG. 5 shows a section through a fourth exemplary embodiment according to the invention.
Figure 6:
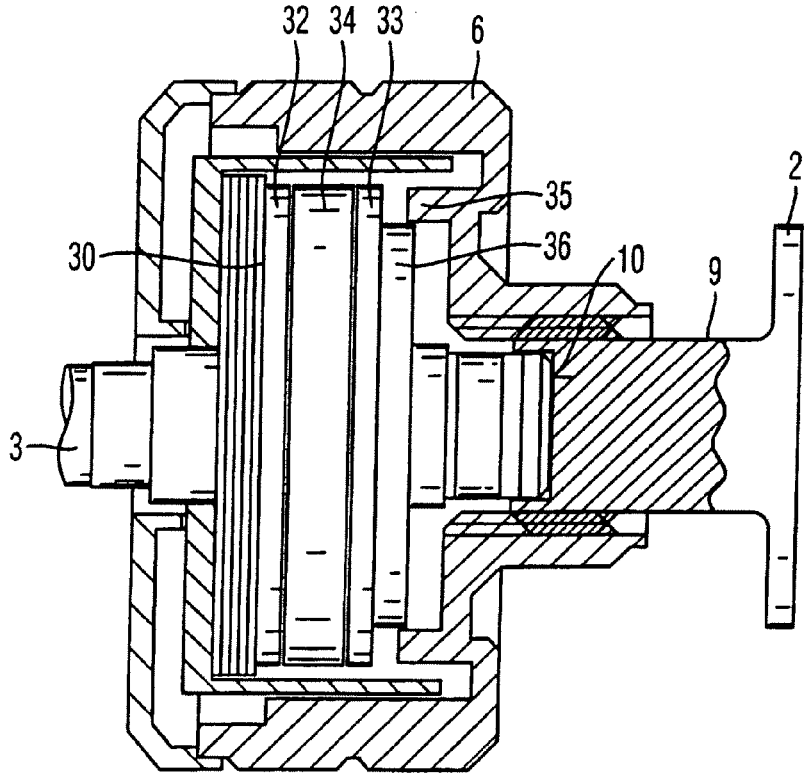
FIG. 6 shows a section through the fourth exemplary embodiment according to the invention in the assembled condition.

Finally, FIGS. 5 and 6 show an arrangement with a unilateral rolling bearing. In this arrangement, the rolling bearing is loaded, if an axial force has built up between the two butting surfaces of the plug and the jack, that is to say, during the course of the tightening process or respectively at the start of the loosening phase. With a loosened connection, the bearing of the cap nut is implemented on various cylindrical surfaces; the rolling bearing is not involved.

As a result of this limitation of the rolling-bearing action on the screw-connection phase, a very cost-favorable, small, axial needle bearing can be used. So that the needle bearing does not rattle or fall apart in the loosened condition, it is preferably held together by spring elements. The unilateral bearing action, presents no restrictions with regard to the embodiments provided above.

Plate springs 29*a*, which act between a cage-like spring retainer 31, which for its part is installed in a form-fit manner in the cap nut 6, and the radial annular wall 30 of two wave washers 32, 33 and a roller bearing 34, which is only illustrated schematically, are pushed onto the outer-conductor of the plug. The plate springs can be guided optionally on the outer-conductor 3 or in the spring retainer 31.

With the cap nut 6 not yet screw-connected to the jack part (FIG. 5), the wave washer 33 is disposed in contact with an annular projection 35 of the cap nut as a result of the spring pre-tensioning, and the rolling-bearing part does not yet press on the flange ring 36 of the outer-conductor. The bearing parts 32, 33, 34 are only held (fixed) in the cap nut 6 by the pre-tensioned plate springs 29*a*. Only when the cap nut 6 is screwed onto the external thread 9 of the schematically indicated jack part 2 (FIG. 6), and the wave washer 33 presses on the flange 36 of the outer-conductor 3, is the force-fit between the wave washer 33 and the annular projection 35 released, and the axial compressive force is transferred via the cap nut 6 and the plate springs 29*a* to the needle bearing 32, 33, 34 and therefore to the outer-conductor 3.

As a result of the plate springs, the necessary axial displacement for the assembly of the bearing parts 32, 33, 34 and the spring retainer 31 with the cap nut 6 is guaranteed (bayonet locking of the spring retainer 31 with cap nut 6). The bearing parts 32, 33, 34 are held together by these plate springs within the cap nut, wherein thermal, longitudinal changes of the plug connector are compensated without the occurrence of distortion. Moreover, the use of springs allows a more cost-favorable manufacture and assembly of the relevant individual parts, because a disturbing summation of manufacturing tolerances is compensated without difficulty by the spring elements. How many plate springs are used will also depend upon the optimisation of these spring functions; in the simplest case, a single plate spring is sufficient; in the exemplary embodiment, five plate springs are illustrated.

The invention is not restricted to the exemplary embodiments illustrated and is suitable not only for so-called N-plugs but also for all types of commercially-available coaxial plug connectors. All of the features described and/or illustrated can be combined with one another as required within the framework of the invention.

The invention claimed is:

1. Coaxial plug-connector part comprising:

a cap nut disposed rotatably and in an axial force-fit manner on an outer-conductor, which can be screw-connected in order to generate the contact pressure between outer-conductor butting contact surfaces of the plug connector part with an external thread of a counter plug-connector part, wherein the frictional torque of the axial force-fit between the cap nut and the outer-conductor is selected to be smaller than the frictional torque between the outer-conductor butting contact surfaces of the plug connector, and wherein the axial force-fit between the cap nut and the outer-conductor is provided via a retaining ring, and the coefficient of friction between the cap nut and the outer-conductor $\mu_s$ is selected, such that a diameter ratio of the retaining ring $d_s$ and outer-conductor butting contact phases $d_o$, is smaller than a coefficient of adhesion $\mu'_0$ of the butting contact surfaces, and hold the relation:

$$\mu_s < \mu'_o \frac{d_o}{d_s}.$$

2. Plug-connector part according to claim 1, wherein the frictional torque of the axial force-fit between the cap nut and the outer-conductor is selected to be 20% to 50% smaller than the frictional torque between the outer-conductor butting contact surfaces.

3. Plug-connector part according to claim 1, wherein a retaining ring is disposed between the cap nut and the outer-conductor, and a surface of the retaining ring and/or surfaces of the cap nut or respectively of the outer-conductor cooperating with this retaining ring provide a slidable coating.

4. Plug-connector part according to claim 3, wherein the slidable coating is a lubricating agent or a film made of Teflon or nano-technological material.

5. Plug-connector part according to claim 3, wherein the low coefficient of friction is achieved through different materials of at least one of the cap nut, the retaining ring, and the outer-conductor.

6. Coaxial Plug connector part according to claim 1, wherein the axial force-fit between the cap nut and the outer-conductor is implemented via a roller bearing.

7. Plug-connector part according to claim 6, wherein the axial force-fit is implemented via a double roller bearing acting in both axial directions.

8. Plug-connector part according to claim 6, wherein the axial force-fit is implemented by a unilaterally-active roller bearing, which acts when the outer-conductor butting contact surfaces press against one another.

9. Plug-connector part according to claim 8, wherein in the released condition of the plug connector, the unilateral roller bearing is held together by spring elements in the cap nut.

10. Coaxial plug-connector part comprising:

a cap nut disposed rotatably and in an axial force-fit manner on an outer-conductor, which can be screw-connected in order to generate the contact pressure between outer-conductor butting contact surfaces of the plug connector part with an external thread of a counter plug-connector part, wherein the frictional torque of the axial force-fit between the cap nut and the outer-conductor is selected to be smaller than the frictional torque between the outer-conductor butting contact surfaces of the plug connector, wherein the axial force-fit between the cap nut and the outer-conductor is implemented by a unilaterally-active roller bearing, which acts when the outer-conductor butting contact surfaces press against one another, wherein in the released condition of the plug connector, the unilaterally-active roller bearing is held together by spring elements in the cap nut, and wherein the tension springs cooperate in such a manner with the unilaterally-active roller bearing, that the unilaterally-active roller bearing adopts a position, in which the axial force-fit between the cap nut and the outer-conductor is manufactured via the unilaterally-active roller bearing only during the screw-connection of the cap nut with the external thread of the counter plug-connector part.

* * * * *

UNITED STATES PATENT AND TRADEMARK OFFICE

CERTIFICATE OF CORRECTION

PATENT NO. : 7,938,663 B2
APPLICATION NO. : 12/375483
DATED : May 10, 2011
INVENTOR(S) : Markus Leipold et al.

It is certified that error appears in the above-identified patent and that said Letters Patent is hereby corrected as shown below:

On the Cover Page:

At field (30), "10 2007 009 516" should be -- 10 2007 009 516.5 --.

At field (30), "10 2007 022 744" should be -- 10 2007 022 744.4 --.

In the Claims:

At Column 8, line 18, "Coaxial Plug connector" should be -- Plug-connector --.

Signed and Sealed this
Twenty-eighth Day of August, 2012

David J. Kappos

David J. Kappos
*Director of the United States Patent and Trademark Office*